US011535040B2

(12) United States Patent
Motegi

(10) Patent No.: US 11,535,040 B2
(45) Date of Patent: Dec. 27, 2022

(54) LIQUID DISCHARGE APPARATUS, INSPECTION METHOD, AND NON-TRANSITORY COMPUTER-READABLE STORAGE MEDIUM

(71) Applicant: Akio Motegi, Tokyo (JP)

(72) Inventor: Akio Motegi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/341,636

(22) Filed: Jun. 8, 2021

(65) Prior Publication Data

US 2022/0009246 A1 Jan. 13, 2022

(30) Foreign Application Priority Data

Jul. 9, 2020 (JP) ..... JP2020-118778

(51) Int. Cl.
*B41J 2/21* (2006.01)
*B41J 29/393* (2006.01)

(52) U.S. Cl.
CPC ..... *B41J 2/2142* (2013.01); *B41J 29/393* (2013.01); *B41J 2029/3935* (2013.01)

(58) Field of Classification Search
CPC ..... B41J 29/393; B41J 2/2142; B41J 2/2146; B41J 2/2139; B41J 2/0451; B41J 2/04558; B41J 2/2132; B41J 2/04505; B41J 2/16579; B41J 2029/3935; B41J 2202/21; B41J 2/16585; B41J 2/155
See application file for complete search history.

(56) References Cited

U.S. PATENT DOCUMENTS

2017/0232770 A1* 8/2017 Akiyama ..... B41J 29/393 347/51

FOREIGN PATENT DOCUMENTS

| | | |
|---|---|---|
| JP | 2005-084543 | 3/2005 |
| JP | 2007-054970 | 3/2007 |
| JP | 2020-146947 | 9/2020 |

* cited by examiner

*Primary Examiner* — Jannelle M LeBron
(74) *Attorney, Agent, or Firm* — IPUSA, PLLC

(57) ABSTRACT

A liquid discharge apparatus includes a plurality of liquid dischargers and circuitry. The plurality of liquid dischargers is configured to discharge liquids of a plurality of colors from discharge holes to form an inspection image on a recording medium. The circuitry is configured to detect a failure of the discharge holes, based on the inspection image formed on the recording medium with the liquids of the plurality of colors. The inspection image includes linear images of the plurality of colors extending in a first direction and arrayed in a second direction intersecting the first direction. Linear images of at least two colors, of the linear images of the plurality of colors, are positioned to overlap each other in the first direction.

9 Claims, 9 Drawing Sheets

LIQUID DISCHARGE APPARATUS, INSPECTION METHOD, AND NON-TRANSITORY COMPUTER-READABLE STORAGE MEDIUM

CROSS-REFERENCE TO RELATED APPLICATION

This patent application is based on and claims priority pursuant to 35 U.S.C. § 119(a) to Japanese Patent Application No. 2020-118778, filed on Jul. 9, 2020, in the Japan Patent Office, the entire disclosure of which is hereby incorporated by reference herein.

BACKGROUND

Technical Field

Embodiments of the present disclosure relate to a liquid discharge apparatus, an inspection method, and a non-transitory computer-readable storage medium storing program code that causes a computer to perform the inspection method.

Related Art

There has been known a method, for a liquid discharge apparatus that discharges liquid from discharge holes such as nozzles to form an image on a recording medium, of inspecting the discharge holes for failure to prevent image degradation that may be caused by, e.g., a liquid discharge failure or discharge bending.

SUMMARY

In one embodiment of the present disclosure, a novel liquid discharge apparatus includes a plurality of liquid dischargers and circuitry. The plurality of liquid dischargers is configured to discharge liquids of a plurality of colors from discharge holes to form an inspection image on a recording medium. The circuitry is configured to detect a failure of the discharge holes, based on the inspection image formed on the recording medium with the liquids of the plurality of colors. The inspection image includes linear images of the plurality of colors extending in a first direction and arrayed in a second direction intersecting the first direction. Linear images of at least two colors, of the linear images of the plurality of colors, are positioned to overlap each other in the first direction.

Also described are novel inspection method and non-transitory, computer-readable storage medium storing computer-readable program code that causes a computer to perform the inspection method.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
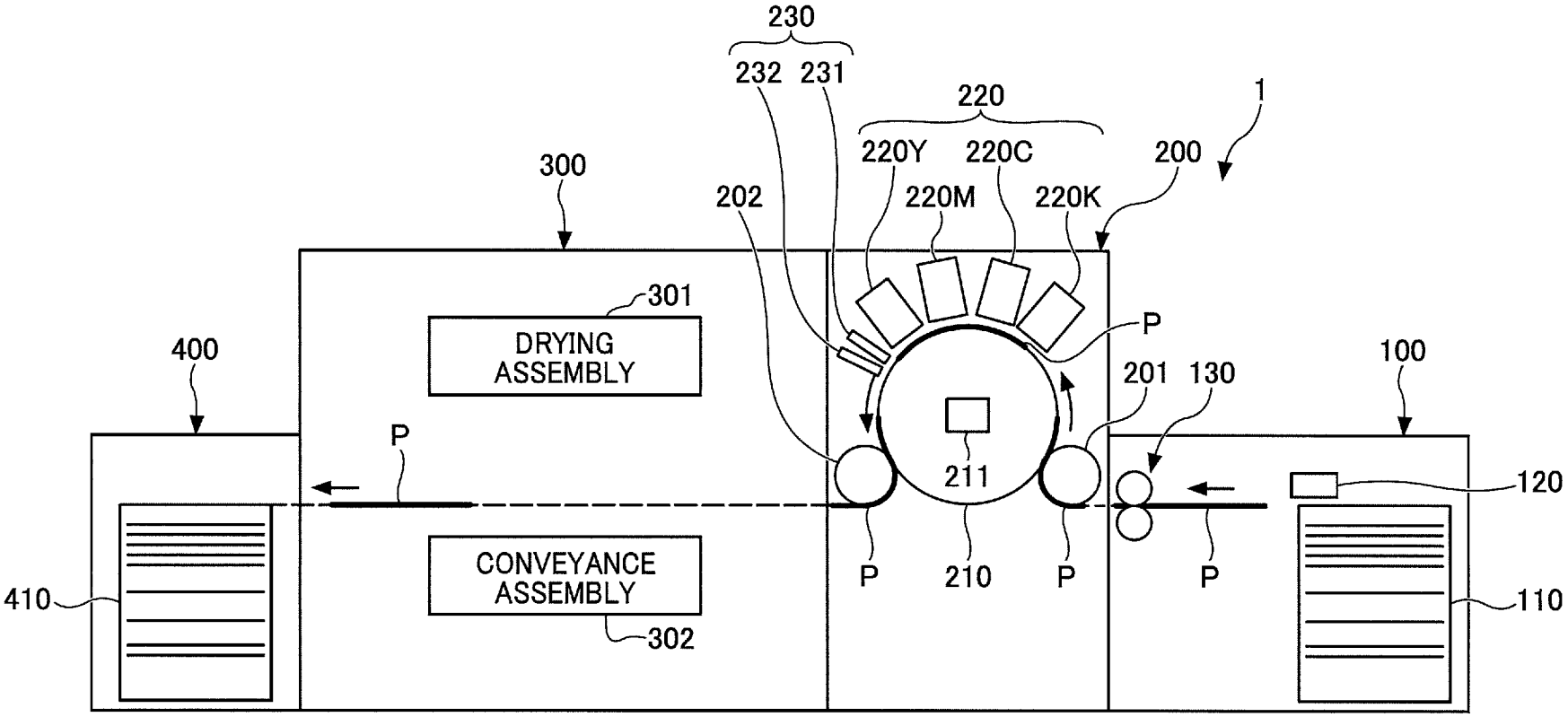
FIG. 1 is a diagram illustrating an overall configuration of a liquid discharge apparatus according to an embodiment.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result. As used herein, the singular forms "a," "an," and "the" are intended to include the plural forms as well, unless the context clearly indicates otherwise.

In a later-described comparative example, embodiment, and exemplary variation, for the sake of simplicity, like reference numerals are given to identical or corresponding constituent elements such as parts and materials having the same functions, and redundant descriptions thereof are omitted unless otherwise required.

It is to be noted that, in the following description, suffixes Y, M, C, and K denote colors of yellow, magenta, cyan, and black, respectively. To simplify the description, these suffixes are omitted unless necessary.

Referring to the drawings, wherein like reference numerals designate identical or corresponding parts throughout the several views, embodiments of the present disclosure are described below.

In the terms of the embodiments, image formation, recording, and printing are synonymous.

In the embodiments, a sheet, which is a sheet material cut out to a given size, is described as an example of a recording medium, while an on-demand line-scanning inkjet image forming apparatus is described as an example of a liquid discharge apparatus. Specific examples of the sheet include, but are not limited to, plain paper, coated paper having coated surfaces, and a film. Ink is an example of liquid.

Now, a description is given of a first embodiment.

Initially with reference to FIG. 1, a description is given of an overall configuration of an image forming apparatus 1 serving as a liquid discharge apparatus.

FIG. 1 is a diagram illustrating an example of the overall configuration of the image forming apparatus 1.

The image forming apparatus 1 includes a sheet feeding device 100, an image forming device 200, a drying device 300, and a sheet ejection device 400. In the image forming apparatus 1, the image forming device 200 forms an image with ink for image formation on a sheet P fed from sheet feeding device 100. The drying device 300 dries the ink adhering to the sheet P. Thereafter, the sheet ejection device 400 ejects the sheet P.

Now, a detailed description is given of the sheet feeding device 100.

The sheet feeding device 100 includes an input tray 110, a sheet feeder 120, and a registration roller pair 130. A plurality of sheets P is stackable on the input tray 110. The sheet feeder 120 separates and feeds the sheets P one at a time from the input tray 110. The registration roller pair 130 sends the sheet P to the image forming device 200. Any sheet feeder may be used as the sheet feeder 120, such as a device with a roller or a device with air suction. After the leading end of the sheet P fed from the input tray 110 by the sheet feeder 120 reaches the registration roller pair 130, the registration roller pair 130 is driven at a given time to feed the sheet P to the image forming device 200. Note that sheet feeding device 100 may have any configuration provided that the sheet feeding device 100 sends the sheets P to the image forming device 200.

Now, a detailed description is given of the image forming device 200.

The image forming device 200 includes a receiving cylinder 201, a conveyance drum 210, and a plurality of ink dischargers 220. The receiving cylinder 201 receives the fed sheet P. The conveyance drum 210 conveys the sheet P while bearing the sheet P on an outer circumferential surface of the conveyance drum 210. The plurality of ink dischargers 220 discharge ink from nozzles toward the sheet P borne on the conveyance drum 210. The image forming device 200 further includes a transfer cylinder 202 and a scanner 230. The transfer cylinder 202 transfers the sheet P conveyed by the conveyance drum 210 to the drying device 300. The scanner 230 reads an inspection image (or a test pattern image) formed on the sheet P when inspecting a nozzle failure in the plurality of ink dischargers 220.

As the leading end of the sheet P conveyed from the sheet feeding device 100 to the image forming device 200 is held by a sheet gripper provided on the surface of the receiving cylinder 201, the sheet P is conveyed along with the surface movement of the receiving cylinder 201. The sheet P thus conveyed by the receiving cylinder 201 is delivered to the conveyance drum 210 at a position opposite the conveyance drum 210.

A sheet gripper is also provided on the surface of the conveyance drum 210 to grip the leading end of the sheet P. A plurality of suction holes is dispersedly formed on the surface of the conveyance drum 210. A suction device 211 generates a suction air flow toward the inside of the conveyance drum 210 in each of the suction holes. The leading end of the sheet P delivered from the receiving cylinder 201 to the conveyance drum 210 is held by the sheet gripper, while the sheet P is attracted to the surface of the conveyance drum 210 by the suction air flow. In this state, the sheet P is conveyed along with the surface movement of the conveyance drum 210.

The plurality of ink dischargers 220 discharges inks of four colors, namely, black (K), cyan (C), magenta (M), and yellow (Y) from nozzles to form an image. Specifically, the plurality of ink dischargers 220 includes ink dischargers 220K, 220C, 220M, and 220Y that discharge the inks of black, cyan, magenta, and yellow, respectively. The plurality of ink dischargers 220 is an example of a plurality of liquid dischargers.

The ink dischargers 220K, 220C, 220M, and 220Y may have any configuration provided that the ink dischargers 220K, 220C, 220M, and 220Y discharge inks. The inks of four colors (i.e., KCMY inks) are examples of inks of a plurality of colors. The plurality of ink dischargers 220 is not limited to the ink dischargers 220K, 220C, 220M, and 220Y that discharge inks of black, cyan, magenta, and yellow, respectively. Optionally, the plurality of ink dischargers 220 may include a special ink discharger that discharges a special color ink such as a white ink, a gold ink, or a silver ink. Optionally, the plurality of ink dischargers 220 may include an ink discharger that discharges liquid that does not form an image, such as a surface coating liquid.

The individual discharge operations of the plurality of ink dischargers 220 (specifically, the ink dischargers 220K, 220C, 220M, and 220Y) are controlled by drive signals corresponding to image data. When the sheet P borne on the conveyance drum 210 passes through an area opposite the plurality of ink dischargers 220, the KCMY inks are discharged from nozzles included in each of the ink dischargers 220K, 220C, 220M, and 220Y, respectively. The discharged KCMY inks adhere to the sheet P, thus forming an image according to the image data. Note that the image forming device 200 may have any configuration provided that the image forming device 200 deposits ink on the sheet P to form an image on the sheet P.

The plurality of ink dischargers 220 forms an inspection image, which is used to detect a failure of the nozzles included in each of the ink dischargers 220K, 220C, 220M, and 220Y, on the sheet P.

The scanner 230 is disposed between the plurality of ink dischargers 220 and the transfer cylinder 202. The scanner 230 is a reading device that reads the inspection image formed on the sheet P for detection of the failure of the nozzles. The scanner 230 may be an optical reading device (or an in-line sensor) such as a contact image sensor (CIS).

Now, a detailed description is given of the drying device 300.

The drying device 300 includes a drying assembly 301 and a conveyance assembly 302. The drying assembly 301 dries ink that has adhered to the sheet P in the image forming device 200. The conveyance assembly 302 conveys the sheet P conveyed from the image forming device 200. In the drying device 300, the sheet P conveyed from the image forming device 200 is received by the conveyance assembly 302. Then, the sheet P is conveyed so as to pass through the drying assembly 301 and delivered to the sheet ejection device 400. When the sheet P passes through the drying assembly 301, the ink on the sheet P is subjected to a drying process. In the drying process, liquid components such as moisture in the ink are evaporated and therefore the ink adheres to the sheet P, while curling of the sheet P is prevented.

Now, a detailed description is given of the sheet ejection device 400.

The sheet ejection device 400 includes an output tray 410 on which a plurality of sheets P is stackable. The sheets P conveyed from the drying device 300 are sequentially stacked and held on the output tray 410. Note that, in the present embodiment, the sheet ejection device 400 may have any configuration provided that the sheet ejection device 400 ejects the sheets P.

Now, a description is given of other devices of the image forming apparatus 1.

The image forming apparatus 1 may include other functional devices in addition to the sheet feeding device 100, the image forming device 200, the drying device 300, and the sheet ejection device 400 described above. For example, the image forming apparatus 1 may include a pre-processing device disposed between the sheet feeding device 100 and the image forming device 200 to perform pre-processing of image formation. The image forming apparatus 1 may include a post-processing device disposed between the drying device 300 and the sheet ejection device 400 to perform post-processing of image formation.

Examples of the pre-processing device include, but are not limited to, a device that performs a treatment liquid applying process of applying, to a sheet P, a treatment liquid that reacts with ink to prevent the ink from bleeding. Examples of the post-processing device include, but are not limited to, a device that performs a sheet reverse and conveyance process of reversing a sheet P bearing an image formed by the image forming device 200 on one side of the sheet P and sending the sheet P to the image forming device 200 again to form another image on another side of the sheet P, a device that performs a process of binding a plurality of sheets P bearing images, a correction assembly that corrects sheet deformation, and a cooling assembly that cools down sheets P.

In the present embodiment, the image forming apparatus 1 is described as an example of the liquid discharge apparatus. The liquid discharge apparatus is not limited to an apparatus that includes a liquid discharge head to discharge liquid toward a surface to be dried of a sheet material and that visualizes a meaningful image such as text or a figure with the liquid. For example, the liquid discharge apparatus may be an apparatus that forms a meaningless image such as a pattern. The sheet material may be any material provided that liquid is adherable to the material, even temporarily. Examples of the sheet material include, but are not limited to, paper, thread, fiber, fabric, leather, metal, plastic, glass, wood, and ceramic. For example, the sheet material may be a material used for film products, cloth products for, e.g., clothing, or leather products, or a material used as a building material such as wallpaper or a floor material. The liquid discharge apparatus may include at least one of devices for feeding, conveying, and ejecting a material to which liquid is adherable. The liquid discharge apparatus may further include at least one of a pre-processing device and a post-processing device.

The "liquid" is not limited to a particular liquid provided that the liquid has a viscosity or surface tension dischargeable from a head. However, preferably, the viscosity of the liquid is not greater than 30 mPa·s under ordinary temperature and ordinary pressure or by heating or cooling. Specific examples of the liquid include, but are not limited to, a solution, a suspension, or an emulsion including, e.g., a solvent such as water or an organic solvent, a colorant such as dye or pigment, a functional material such as a polymerizable compound, a resin, or a surfactant, a biocompatible material such as deoxyribonucleic acid (DNA), amino acid, protein, or calcium, and an edible material such as a natural colorant. Such a solution, a suspension, or an emulsion may be used for, e.g., an inkjet ink or a surface treatment solution.

The liquid discharge apparatus may be an apparatus that relatively moves a liquid discharge head and a sheet material. However, the liquid discharge apparatus is not limited to such an apparatus. For example, the liquid discharge apparatus may be a serial head apparatus that moves the liquid discharge head or a line head apparatus that does not move the liquid discharge head.

The "liquid discharge head" is a functional component that discharges or shoots liquid from discharge orifices (i.e., nozzles). Examples of an energy source for generating energy to discharge liquid include, but are not limited to, a piezoelectric actuator (e.g., a laminated piezoelectric element or a thin-film piezoelectric element), a thermal actuator that employs a thermoelectric conversion element such as a thermal resistor, and an electrostatic actuator including a diaphragm and opposed electrodes.

Figure 2:
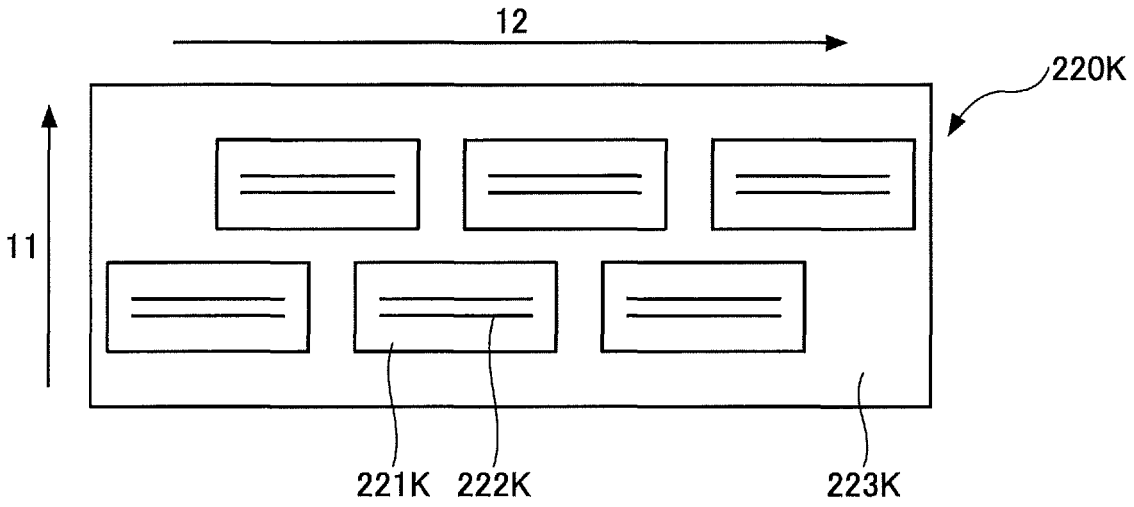
FIG. 2 is a plan view of a configuration of an ink discharger according to an embodiment.
Figure 3:
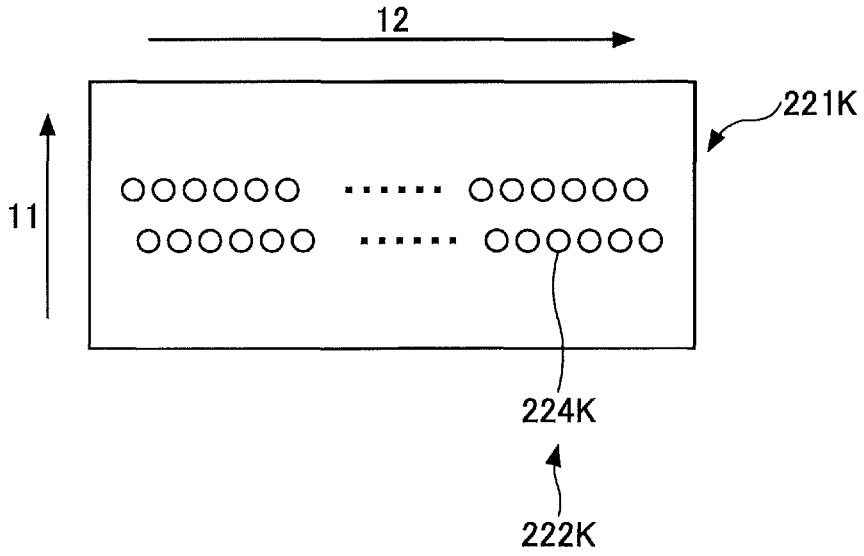
FIG. 3 is a plan view of a configuration of an ink discharge head according to an embodiment.

Referring now to FIGS. 2 and 3, a description is given of a configuration of the ink discharger 220K as a representative of the ink dischargers 220K, 220C, 220M, and 220Y.

FIG. 2 is a plan view of an example of the configuration of the ink discharger 220K.

As illustrated in FIG. 2, the ink discharger 220K is, e.g., a full-line head including a plurality of ink discharge heads 221K serving as liquid discharge heads (in this case, six ink discharge heads 221K) arrayed in a staggered manner on a base 223K. Each of the plurality of ink discharge heads 221K includes at least one nozzle row 222K, which is an array of nozzles. The ink discharge head 221K is an example of a liquid discharger.

FIG. 2 illustrates a conveyance direction 11 and a width direction 12. The conveyance direction 11 is a direction in which a sheet P is conveyed by the conveyance drum 210. The width direction 12 is a width direction (i.e., an axial direction) of the conveyance drum 210. The conveyance direction 11 is perpendicular to the width direction 12. The conveyance direction 11 and the width direction 12 serve as a first direction and a second direction, respectively.

The plurality of ink discharge heads 221K thus arranged allows the ink discharger 220K to discharge ink to a wider range of the sheet P in the width direction 12. The plurality of ink discharge heads 221K is arranged in a staggered manner such that the plurality of ink discharge heads 221K have overlapping discharge areas in the width direction 12. The plurality of ink discharge heads 221K thus arranged prevents an unintended blank area in which ink is not discharged in the width direction 12.

The number of the ink discharge heads 221K of the ink discharger 220K is not limited to six. The number of the ink discharge heads 221K in an array in the width direction 12 is not limited to three. The number of the ink discharge heads 221K is selectable as appropriate for the purpose.

Although FIG. 2 illustrates an example of the configuration of the black ink discharger 220K, the ink dischargers 220K, 220C, 220M, and 220Y may have identical configurations, differing from each other only in ink colors.

FIG. 3 is a plan view of one of the ink discharge heads 221K included in the ink discharger 220K.

The nozzle row 222K includes a plurality of nozzles 224K arrayed along the width direction 12.

In the present embodiment, ink is discharged from each of the plurality of nozzles 224K according to image data. However, for example, extraneous matter adhering to the nozzle 224K may cause a nozzle failure such as a discharge failure in which the nozzle 224K fails to discharge ink or discharge bending that ink is discharged while bending. A nozzle failure degrades an image formed on a sheet P. In the present embodiment, in order to inspect such a nozzle failure, the scanner 230 is disposed downstream from the plurality of ink dischargers 220 in the conveyance direction 11.

Figure 4:
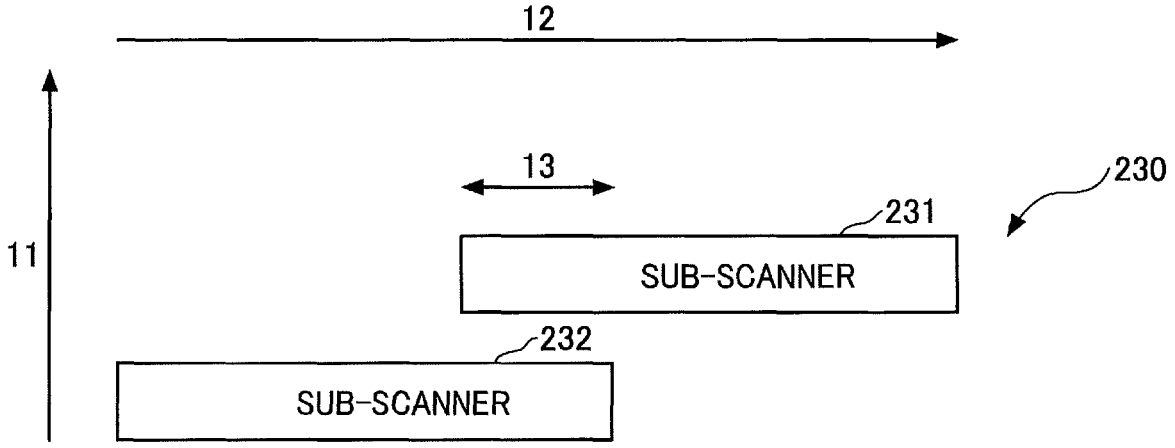
FIG. 4 is a diagram illustrating an arrangement of a scanner according to an embodiment.

Referring now to FIG. 4, a description is given of an arrangement of the scanner 230.

FIG. 4 is a diagram illustrating an example of the arrangement of the scanner 230.

The scanner 230 includes sub-scanners 231 and 232 to read a wider range in the width direction 12 than a range readable by a single sub-scanner. The sub-scanners 231 and 232 are arranged in a staggered manner such that the sub-scanners 231 and 232 have overlapping read areas in the width direction 12. The sub-scanners 231 and 232 thus arranged prevents an unintended read blank area, which is an area unreadable by the sub-scanners 231 and 232, in the width direction 12.

FIG. 4 illustrates an overlapping range 13 in which the read area of the sub-scanner 231 and the read area of the sub-scanner 232 overlap each other in the width direction 12. Note that the number of sub-scanners constructing the scanner 230 is not limited to two. The number of sub-scanners is selectable as appropriate for the purpose.

The scanner 230 reads an inspection image formed for inspection of a nozzle failure on a sheet P that is conveyed by the conveyance drum 210 while being attracted to the conveyance drum 210 (as illustrated in FIG. 1). A controller 500, described below, detects a failure of nozzles included in each of the ink dischargers 220K, 220C, 220M, and 220Y, based on read data of the inspection image provided by the scanner 230.

Figure 5:
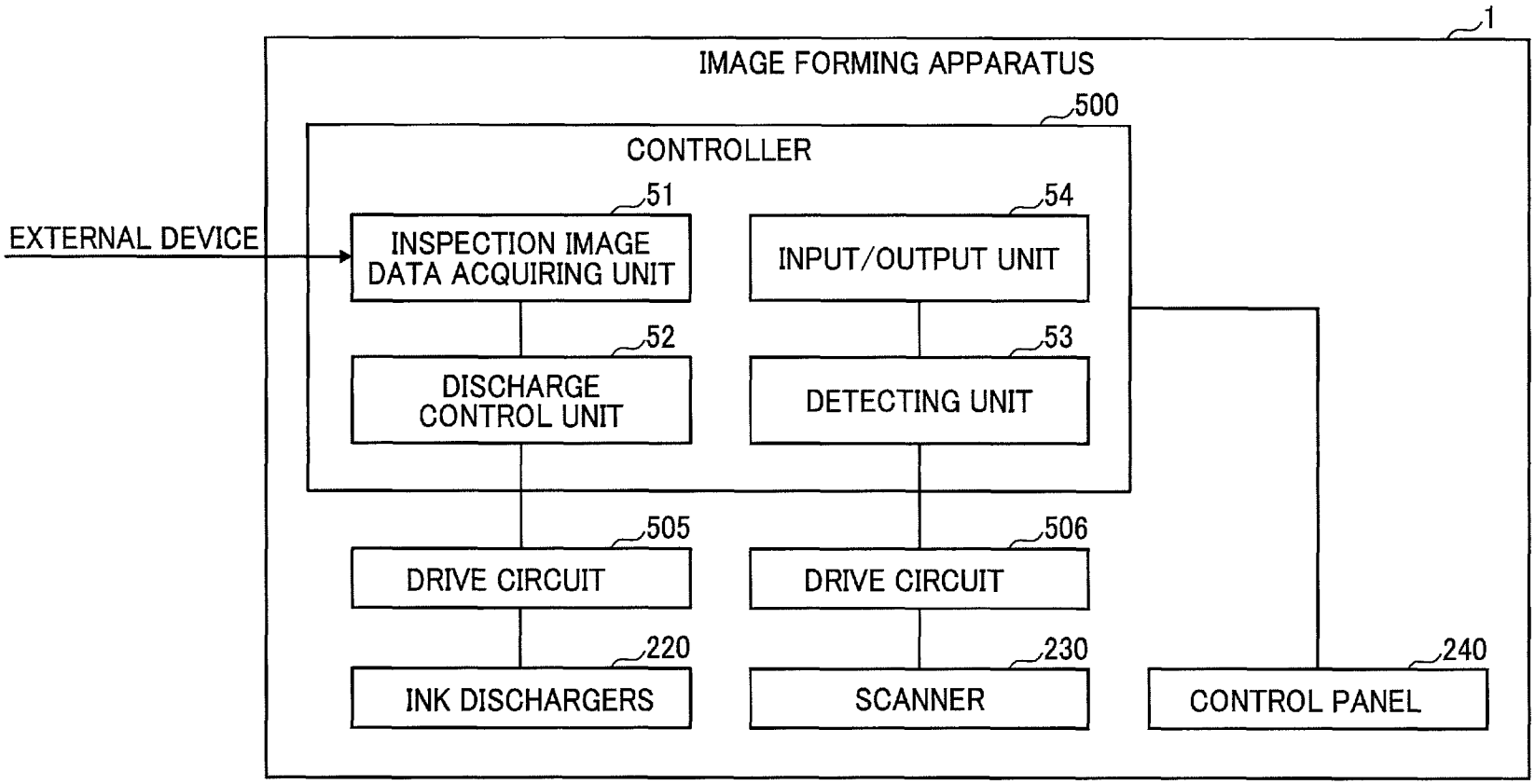
FIG. 5 is a block diagram illustrating a functional configuration of a controller according to an embodiment.

Referring now to FIG. 5, a description is given of a functional configuration of the controller 500 in the image forming apparatus 1.

FIG. 5 is a block diagram illustrating an example of the functional configuration of the controller 500.

Note that, in the image forming apparatus 1 (illustrated in FIG. 1), the controller 500 may be disposed at a position at which the controller 500 that does not hinder image formation on a sheet P.

As illustrated in FIG. 5, the controller 500 includes, as functional units, an inspection image data acquiring unit 51, a discharge control unit 52, a detecting unit 53, and an input/output unit 54. Such functional units of the controller 500 may be implemented by an electric circuit. Some of the functional units of the controller 500 may be implemented by software (or central processing unit (CPU)). The functional units of the controller 500 may be implemented by a plurality of circuits or a plurality of software components.

The inspection image data acquiring unit 51 acquires, from an external device such as a personal computer (PC), image data according to which an inspection image is formed. Alternatively, in a case in which a storage device such as a hard disk drive (HDD) of the controller 500 stores image data according to which an inspection image is formed, the inspection image data acquiring unit 51 may acquire, with reference to the storage device, the image data according to which the inspection image is formed. Alternatively, the inspection image data acquiring unit 51 may acquire, from the external device or the like, parameter information for generating image data according to which an inspection image is formed, and calculate the image data according to which the inspection image is formed, based on the parameter information. Thus, the inspection image data acquiring unit 51 may acquire the image data according to which the inspection image is formed. The parameter information is information such as the length, thickness, and number of lines in a linear image.

The discharge control unit 52 causes, via a drive circuit 505, the plurality of ink dischargers 220 to form an inspection image on a sheet P according to image data of an inspection image.

The detecting unit 53 detects a nozzle failure, based on an inspection image formed on a sheet P with ink. Specifically, the detecting unit 53 acquires, via a drive circuit 506, read data of the inspection image from the scanner 230. The detecting unit 53 uses a pattern or color of the inspection image of the read data to identify and detect the position of a nozzle having a discharge failure or discharge bending.

The detecting unit 53 outputs the detection result to a control panel 240 via the input/output unit 54. The control panel 240 displays the detection result for a nozzle failure. The control panel 240 includes, e.g., a touch panel and an alarm lamp. The touch panel displays, e.g., a current setting value, a selection screen, and various notifications from the image forming apparatus 1 and receives an input from an operator (or a user) of the image forming apparatus 1.

Thus, the control panel 240 allows the user of the image forming apparatus 1 to visually recognize the detection result for a nozzle failure. In a case in which a nozzle failure is detected, the user of the image forming apparatus 1 may perform a maintenance operation of the ink dischargers 220. Alternatively, the maintenance operation of the ink dischargers 220 may be automatically executed based on the detection result.

Figure 6:
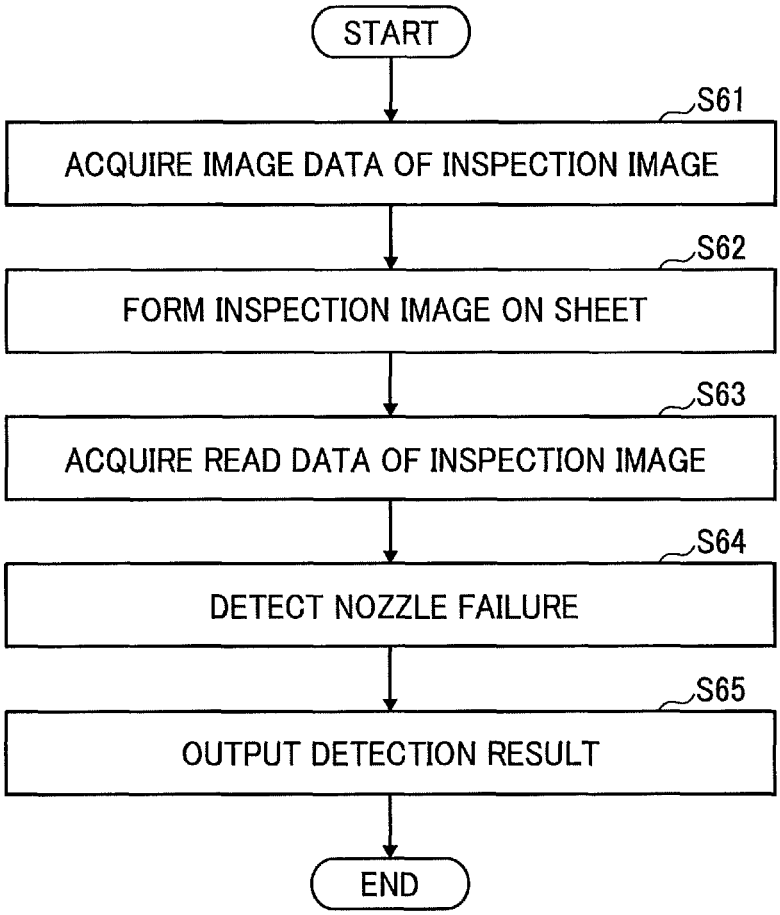
FIG. 6 is a flowchart of a process performed by a controller according to an embodiment.

Referring now to FIG. 6, a description is given of a process performed by the controller 500.

FIG. 6 is a flowchart of an example of the process performed by the controller 500.

FIG. 6 illustrates a process executed by the controller 500 to inspect nozzles for failure.

First, in step S61, the inspection image data acquiring unit 51 acquires, from an external device, image data of an inspection image, that is, image data according to which the inspection image is formed.

Subsequently, in step S62, the discharge control unit 52 causes, via the drive circuit 505, the plurality of ink dischargers 220 to form the inspection image on a sheet P according to the image data of the inspection image.

Subsequently, in step S63, the detecting unit 53 acquires, via the drive circuit 506, read data of the inspection image from the scanner 230.

Subsequently, in step S64, the detecting unit 53 uses a pattern or color of the inspection image of the read data to identify and detect a nozzle failure, specifically, the position of a nozzle having a discharge failure or discharge bending.

Subsequently, in step S65, the detecting unit 53 outputs the detection result to the control panel 240 via the input/output unit 54. The control panel 240 displays the detection result for a nozzle failure.

Thus, the controller 500 executes inspection of nozzles for failure and displays, on the control panel 240, the detection result for a nozzle failure.

Figure 7B:
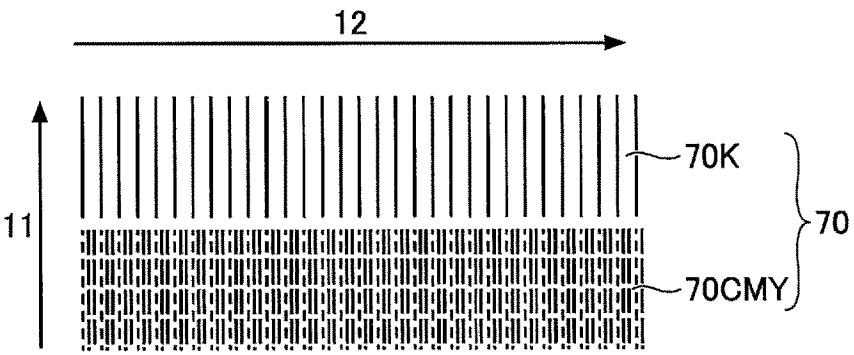
FIG. 7B is a diagram illustrating a first example of an inspection image according to an embodiment.
Figure 7A:
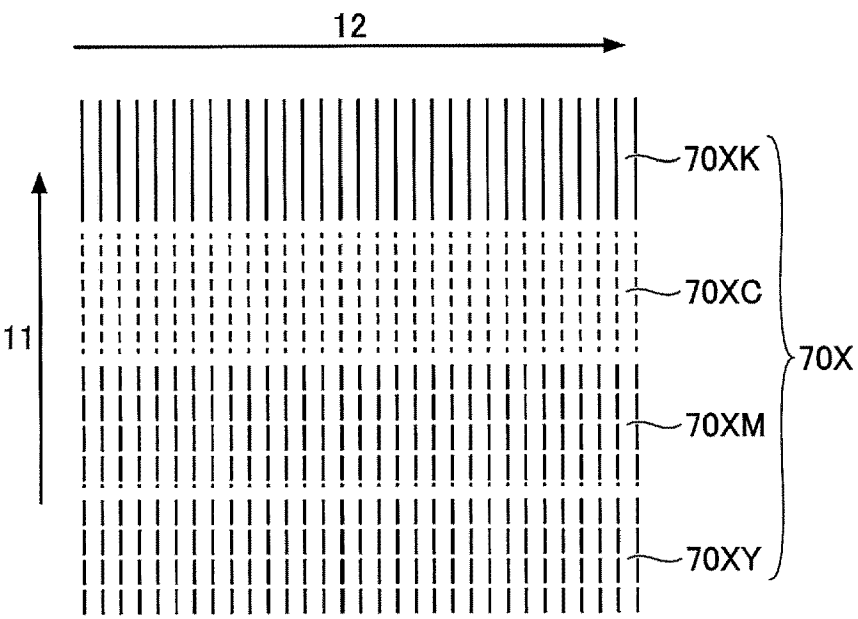
FIG. 7A is a diagram illustrating a comparative inspection image.

Referring now to FIGS. 7A and 7B, a detailed description is given of an example of the inspection image.

FIG. 7A is a diagram illustrating a comparative inspection image. FIG. 7B is a diagram illustrating an inspection image according to the present embodiment.

Each of FIGS. 7A and 7B illustrates an inspection image formed on a sheet (i.e., a recording medium).

As illustrated in FIG. 7A, a comparative inspection image 70X includes a black linear image 70XK having a solid line pattern, a cyan linear image 70XC having a broken line pattern, a magenta linear image 70XM having a one dot chain line pattern, and a yellow linear image 70XY having a two dot chain line pattern.

Here, the linear image is an image including at least one line. However, the linear image is not limited to an image including at least one line that extends in a straight line without interruption. The linear image may be any image that is entirely linear. For example, an image including at least one partially curved line or partially cut-off line may be included in the linear image provided that the image is entirely linear. The same meaning of the term "linear image" applies to linear images 70K and 70CMY described later.

Each of the linear images 70XK, 70XC, 70XM, and 70XY is an image including lines extending along the conveyance direction 11 and arrayed along the width direction 12. The linear images 70XK, 70XC, 70XM, and 70XY are identical pattern images, differing in color from each other. The linear images 70XK, 70XC, 70XM, and 70XY are arranged at different positions in the conveyance direction 11. That is, the positions of the linear images 70XK, 70XC, 70XM, and 70XY do not overlap each other in the conveyance direction 11.

By contrast, as illustrated in FIG. 7B, an inspection image 70 according to the present embodiment includes a black linear image 70K having a solid line pattern and a linear image 70CMY including, as CMY linear images, linear images of three colors, namely, cyan, magenta and yellow. Each of the linear images 70K and 70CMY is an image including lines extending along the conveyance direction 11 and arrayed along the width direction 12.

As described above, the linear image 70CMY includes the CMY linear images. The CMY linear images are identical pattern images, differing in color from each other.

The CMY linear images are arranged at substantially the same position (or identical positions) in the conveyance direction 11. That is, the CMY linear images in the linear image 70CMY extend in the conveyance direction 11 from substantially the same position in the conveyance direction 11 as the starting point to substantially the same position in the conveyance direction 11 as the ending point.

Since the CMY linear images in the linear image 70CMY are arranged at substantially the same position in the conveyance direction 11, the inspection image 70 is shortened in the conveyance direction 11 and thus is reduced in size, compared with the comparative inspection image 70X.

In the example illustrated in FIG. 7B, the CMY linear images in the linear image 70CMY are arranged at substantially the same position in the conveyance direction 11. However, the CMY linear images are not necessarily arranged at substantially the same position in the conveyance direction 11, provided that the CMY linear images are positioned to overlap each other in the conveyance direction 11. Linear images formed with at least two colors of ink, of the linear images formed with a plurality of colors of ink, may be positioned to overlap each other in the conveyance direction 11.

As the linear image 70CMY includes the CMY linear images positioned to overlap each other in the conveyance direction 11, the inspection image 70 is shortened in the conveyance direction 11 by the overlapping amount and thus is reduced in size, as compared with the comparative inspection image 70X.

In the example illustrated in FIG. 7B, the CMY linear images in the linear image 70CMY are identical pattern images. However, the CMY linear images may not necessarily be identical pattern images. In other words, the CMY linear images may have different line length or thickness from each other. In this case, the linear image 70CMY includes linear images formed with at least two colors of ink and positioned to overlap each other in the conveyance direction 11. Accordingly, the inspection image 70 is shortened in the conveyance direction 11 by the overlapping amount and thus is reduced in size, as compared with the comparative inspection image 70X.

Figure 8:
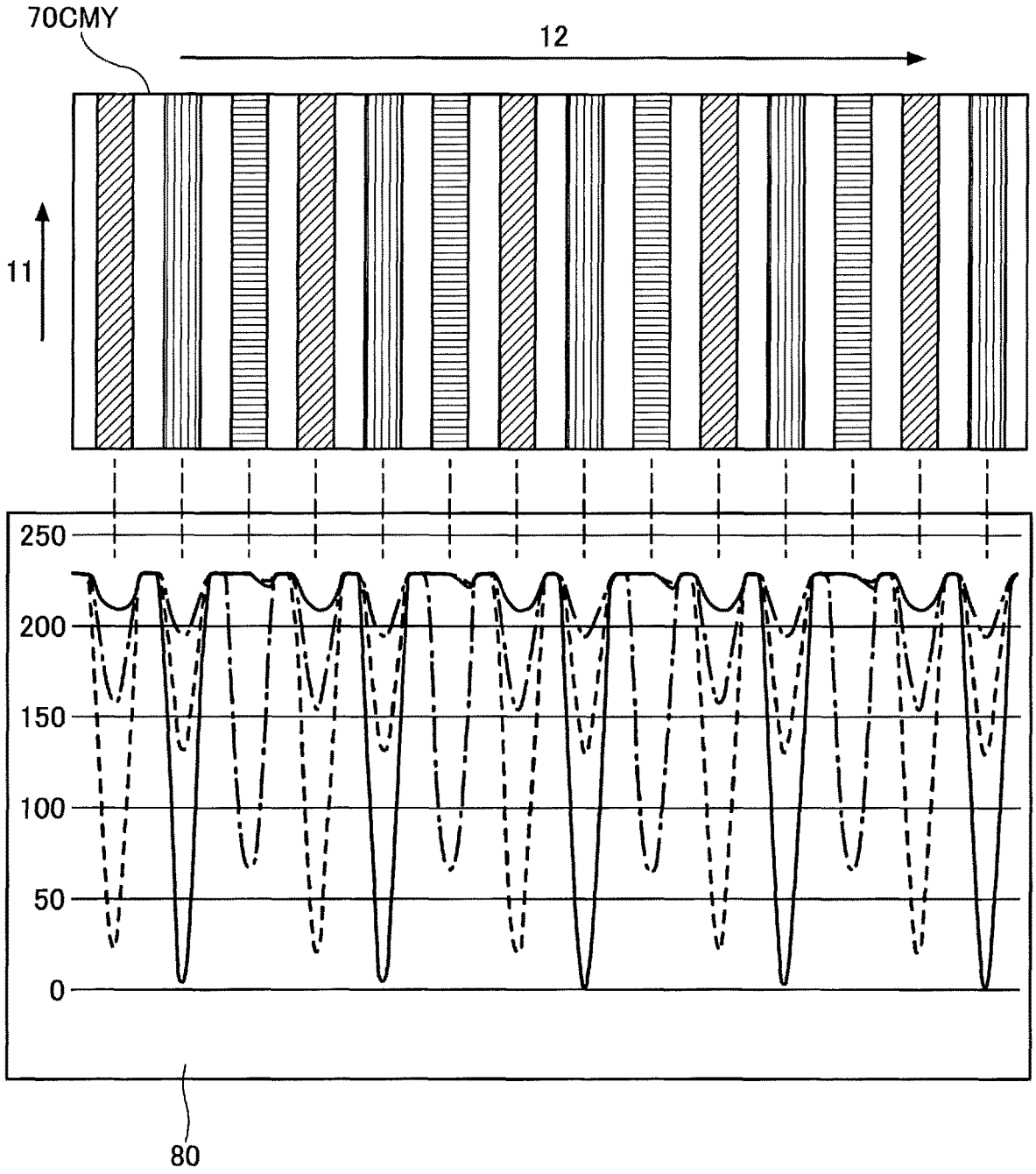
FIG. 8 is a diagram illustrating a relationship in color between an inspection image and read data.

Referring now to FIG. 8, a description is given of a method of detecting a nozzle failure performed by the detecting unit 53 (illustrated in FIG. 5).

FIG. 8 is a diagram illustrating a relationship in color between an inspection image on a sheet and read data provided by the scanner 230 (illustrated in FIG. 1).

The linear image 70CMY is illustrated as an image formed in colors C, M, and Y on a sheet.

On the other hand, read data 80 is read data of the linear image 70CMY provided by the scanner 230. The read data 80 presents a graph illustrating a cross-sectional luminance distribution of the linear image 70CMY. In the graph, the horizontal axis of the graph represents the position in the width direction 12; whereas the vertical axis represents the luminance.

The scanner 230 acquires read data of red (R), green (G), and blue (B). In the graph presented by the read data 80, the solid line indicates read data of R, the broken line indicates read data of G, and the one dot chain line indicates read data of B.

In a case in which the different color linear images are positioned to overlap each other in the conveyance direction 11, the individual linear images may not be extracted in the overlap portions, thus making it hard to detect a nozzle failure, based on the image processing of the linear images.

In order to address such a situation, in the present embodiment, an image of the G component is extracted alone from the read data 80 to extract a magenta linear image, because green (G) is the complementary color to magenta (M). In short, a magenta linear image is extracted from the read data of G. Similarly, a cyan linear image is extracted from the read data of R, because red (R) is the complementary color to cyan (C). A yellow linear image is extracted from the read data of B, because blue (B) is the complementary color to yellow (Y). The detecting unit 53 detects missing or bent patterns from the extracted cyan, magenta, and yellow linear images by image processing. Thus, the detecting unit 53 identifies and detects a nozzle in discharge failure.

In this manner, even for the overlapping portions of the different color linear images in the conveyance direction 11, the detecting unit 53 executes image processing on the color component data of R, G, and B corresponding to the complementary colors to C, M, and Y, respectively, to detect nozzles in discharge failure in the cyan, magenta, and yellow ink dischargers 220C, 220M, and 220Y, respectively.

Note that, since the black linear image and the non-overlapping portions of the cyan, magenta, and yellow linear images in the conveyance direction 11 illustrated in FIGS. 7A and 7B are easily extractable, the detecting unit 53 easily extract a nozzle in discharge failure by image processing.

Now, a description is given of some advantages attained by the image forming apparatus 1.

There is known a method, for an image forming apparatus, of forming an inspection image on a sheet and detecting a nozzle failure based on data of an inspection image read by a scanner, that is, read data of the inspection image provided by the scanner. In a case in which an image forming apparatus uses such a method and forms a larger inspection image on a sheet, the image forming apparatus uses an increased number of sheets to form the inspection images and inspect all nozzles included in ink dischargers. As a result, such a method may waste paper. In particular, in a case in which an image forming apparatus forms an inspection image in a margin area, which is a blank area in which an image to be printed is not formed on a sheet, to inspect nozzles for failure, an increased number of sheets may be used for inspection of all nozzles, or the margin area may be enlarged. As a result, such a method may waste paper or the margin area.

In order to address such a situation, in the present embodiment, an inspection image includes, as KCMY linear images, linear images of four colors, namely, K, C, M, and Y extending in or along a conveyance direction (e.g., the conveyance direction 11) and arrayed in or along a width direction (e.g., the width direction 12) intersecting the conveyance direction. The CMY linear images of the KCMY linear images are positioned to overlap each other in the conveyance direction.

Accordingly, the inspection image is shortened in the conveyance direction by the overlapping amount and thus is reduced in size, as compared with a comparative inspection image that includes KCMY linear images arranged without overlapping each other in the conveyance direction. Thus, the image forming apparatus 1 of the present embodiment inspects a nozzle failure without waste in the number of sheets and waste in the margin area on the sheets.

In the present embodiment, a nozzle failure is detected based on color component data as a complementary color to a color of a linear image of the read data provided by the scanner 230. Accordingly, the individual linear images are extracted even from the overlapping portions of the different color linear images in the conveyance direction. As a result, a nozzle failure is detected by image processing.

Note that, in a case in which inks of colors other than C, M, and Y, such as colors of white, gold, silver, orange, green, and violet, are used, extracting one color component of R, G, or B corresponding to a complementary color to such a color other than C, M, and Y may be insufficient to extract the individual linear images from the overlapping portions of the different color linear images in the conveyance direction. In this case, in the present embodiment, a plurality of pieces of color component data is extracted from the read data of the scanner 230. Accordingly, the individual linear images are extracted even from the overlapping portions of the different color linear images in the conveyance direction. As a result, a nozzle failure is detected by image processing.

Now, a description is given of other embodiments of the present disclosure.

Figure 9:
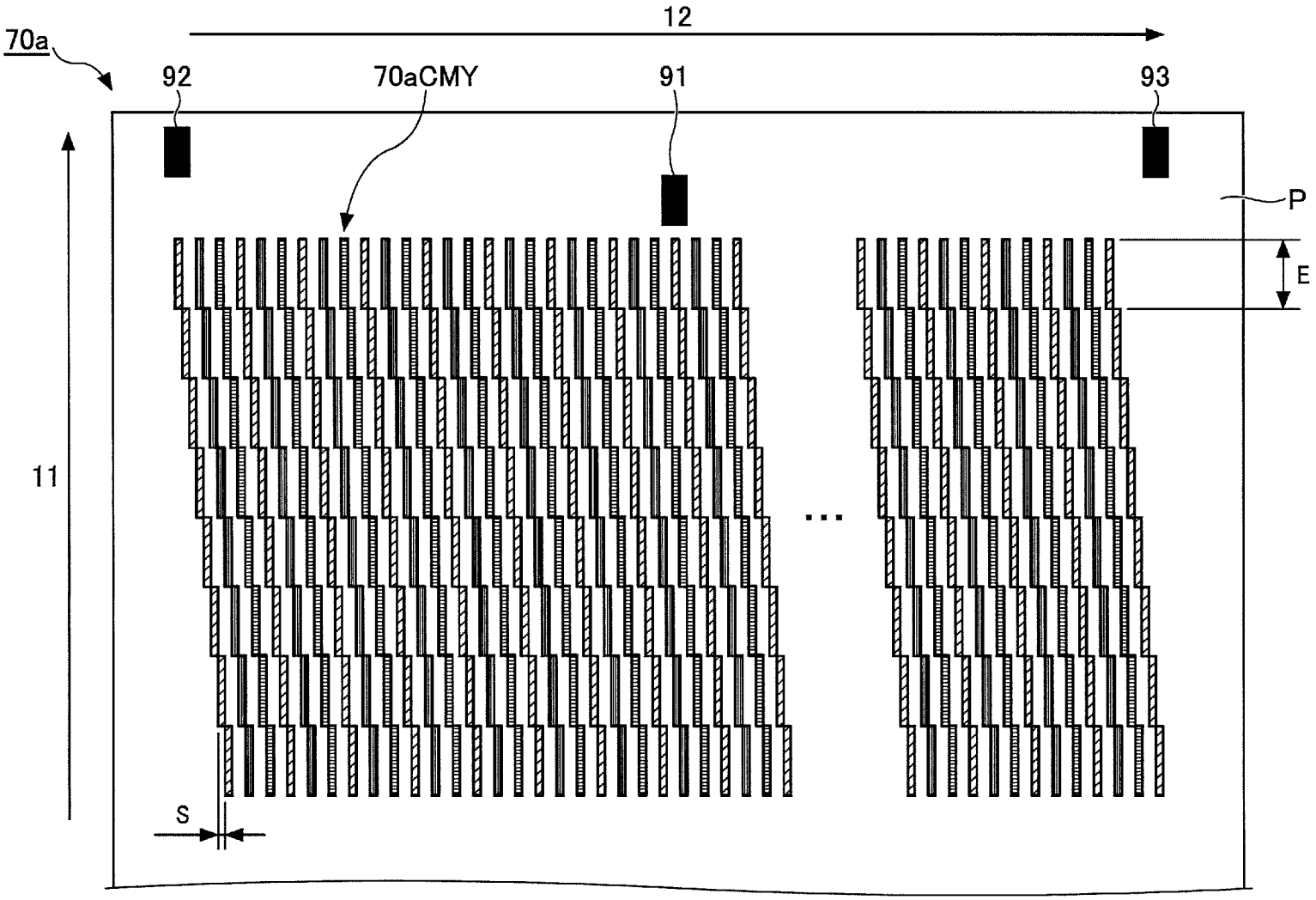
FIG. 9 is a diagram illustrating a second example of an inspection image according to an embodiment.

FIG. 9 is a diagram illustrating an inspection image 70*a* as a second example of an inspection image according to an embodiment.

As illustrated in FIG. 9, the inspection image 70*a* includes a starting mark 91, ending marks 92 and 93, and a linear image 70*a*CMY. FIG. 9 illustrates the starting mark 91, the ending marks 92 and 93, and the linear image 70*a*CMY formed on a sheet P.

The starting mark 91 is a mark indicating a position at which a process of detecting a nozzle failure is started on the sheet P. Each of the ending marks 92 and 93 is a mark indicating a position at which the process of detecting a nozzle failure ends on the sheet P.

The linear image 70*a*CMY includes linear images of three colors, namely, C, M, and Y (i.e., CMY linear images) extending along the conveyance direction 11 and arrayed along the width direction 12. The CMY linear images in the linear image 70*a*CMY are positioned to overlap each other in the conveyance direction 11.

In the linear image 70*a*CMY, each of the CMY linear images does not extend straight along the conveyance direction 11. Instead, each of the CMY linear images extends by a given extension amount E along the conveyance direction 11 and is shifted by a given shift amount S along the width direction 12. The extension amount E and the shift amount S of each of the CMY linear images are adjustable as appropriate.

Thus, a nozzle failure is inspectable with the inspection image 70*a* described above. Note that the inspection image 70*a* does not necessarily include the starting mark 91 and the ending marks 92 and 93.

Figure 10:
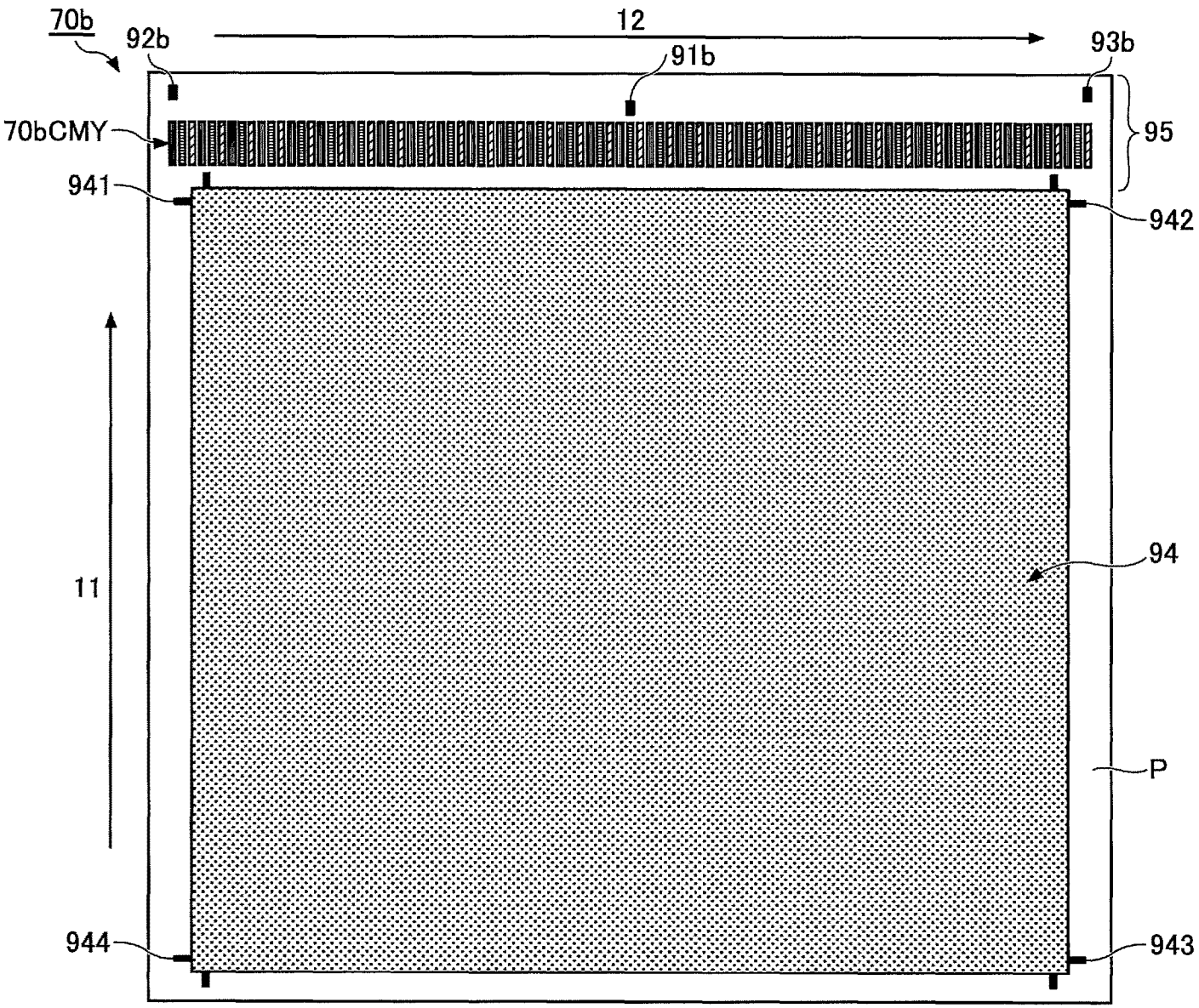
FIG. 10 is a diagram illustrating a third example of an inspection image according to an embodiment.

FIG. 10 is a diagram illustrating an inspection image 70*b* as a third example of an inspection image according to an embodiment.

As illustrated in FIG. 10, the inspection image 70*b* includes a starting mark 91*b*, ending marks 92*b* and 93*b*, and a linear image 70*b*CMY. FIG. 10 illustrates the starting mark 91*b*, the ending marks 92*b* and 93*b*, and the linear image 70*b*CMY formed on a sheet P.

FIG. 10 illustrates a print image 94 as an image to be formed. Each of positioning marks 941, 942, 943, and 944 is a mark to determine a position at which the print image 94 is formed on the sheet P.

A margin area 95 is an area in which the print image 94, as an image forming target, is not formed, on the sheet P. In other words, the margin area 95 is a blank area other than an area in which the print image 94 is formed on the sheet P. The starting mark 91*b*, the ending marks 92*b* and 93*b*, and the linear image 70*b*CMY are formed in the margin area 95.

The linear image 70*b*CMY includes linear images of three colors, namely, C, M, and Y (i.e., CMY linear images) extending along the conveyance direction 11 and arrayed along the width direction 12. The CMY linear images in the linear image 70*b*CMY are positioned to overlap each other in the conveyance direction 11.

Formation of the linear image 70*b*CMY in the margin area 95 as described above allows detection of a nozzle failure in parallel with formation of the print image 94. Accordingly, the present example or embodiment saves time to detect a nozzle failure while reducing waste of paper by utilizing a blank area (e.g., the margin area 95). Since a special area for forming the inspection image is not provided on the sheet P, the present example or embodiment is particularly preferable for an image forming apparatus employing a line-scanning inkjet system.

The embodiments have been described as applied to the image forming apparatus 1 employing the line-scanning ink jet system. Alternatively, one or more embodiments of the present disclosure may be applied to an image forming apparatus employing a serial-scanning inkjet system. Such an image forming apparatus may attain substantially the same advantages as the advantages attained by the image forming apparatus 1 described above.

The embodiments also include an inspection method. For example, the inspection method includes: discharging liquids of a plurality of colors from discharge holes of a plurality of liquid dischargers to form an inspection image on a recording medium; and detecting a failure of the discharge holes, based on the inspection image formed on the recording medium with the liquids of the plurality of colors. The inspection image includes linear images of the plurality of colors extending in a first direction and arrayed in a second direction intersecting the first direction. Linear images of at least two colors, of the linear images of the plurality of colors, are positioned to overlap each other in the first direction. Such an inspection method attains substantially the same advantages as the advantages attained by the liquid discharge apparatus (e.g., the image forming apparatus 1) described above.

The embodiments also include a non-transitory, computer-readable storage medium storing computer-readable program code. For example, the program code causes a computer to perform an inspection method that includes: discharging liquids of a plurality of colors from discharge holes of a plurality of liquid dischargers to form an inspection image on a recording medium; and detecting a failure of the discharge holes, based on the inspection image formed on the recording medium with the liquids of the plurality of colors. The inspection image includes linear images of the plurality of colors extending in a first direction and arrayed in a second direction intersecting the first direction. Linear images of at least two colors, of the linear images of the plurality of colors, are positioned to overlap each other in the first direction. Such a non-transitory, computer-readable storage medium attains substantially the same advantages as the advantages attained by the liquid discharge apparatus (e.g., the image forming apparatus 1) described above.

According to the embodiments of the present disclosure, an inspection image is reduced in size.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

What is claimed is:

1. A liquid discharge apparatus comprising:

a plurality of liquid dischargers configured to discharge liquids of a plurality of colors from discharge holes to form an inspection image on a recording medium; and circuitry configured to detect a failure of the discharge holes, based on the inspection image formed on the recording medium with the liquids of the plurality of colors, the inspection image including linear images of the plurality of colors extending in a first direction and arrayed in a second direction intersecting the first direction, linear images of at least two colors, of the linear images of the plurality of colors, being positioned to overlap each other in the first direction, and wherein a linear image of a first color is arranged at substantially the same position as a linear image of a second color in the first direction; the second color differing from the first color.

2. The liquid discharge apparatus according to claim 1, wherein the first direction is a direction in which the recording medium is conveyed.

3. The liquid discharge apparatus according to claim 1, further comprising a reading device configured to read the inspection image, wherein the circuitry is configured to detect the failure, based on read data of the inspection image provided by the reading device.

4. The liquid discharge apparatus according to claim 3, wherein the circuitry is configured to detect the failure, based on color component data as a complementary color to a color of the plurality of colors of the linear images of the read data.

5. The liquid discharge apparatus according to claim 2, wherein the circuitry is configured to detect the failure, based on a plurality of pieces of color component data of the read data.

6. The liquid discharge apparatus according to claim 1, wherein the liquid discharge apparatus is a line-scanning liquid discharge apparatus.

7. The liquid discharge apparatus according to claim 6, wherein the inspection image is formed in a blank area other than an area in which an image is formed on the recording medium.

8. An inspection method comprising:

discharging liquids of a plurality of colors from discharge holes of a plurality of liquid dischargers to form an inspection image on a recording medium; and detecting a failure of the discharge holes, based on the inspection image formed on the recording medium with the liquids of the plurality of colors, the inspection image including linear images of the plurality of colors extending in a first direction and arrayed in a second direction intersecting the first direction, linear images of at least two colors, of the linear images of the plurality of colors, being positioned to overlap each other in the first direction, and wherein a linear image of a first color is arranged at substantially the same position as a linear image of a second color in the first direction; the second color differing from the first color.

9. A non-transitory, computer-readable storage medium storing computer-readable program code that causes a computer to perform an inspection method, the method comprising:

discharging liquids of a plurality of colors from discharge holes of a plurality of liquid dischargers to form an inspection image on a recording medium; and detecting a failure of the discharge holes, based on the inspection image formed on the recording medium with the liquids of the plurality of colors, the inspection image including linear images of the plurality of colors extending in a first direction and arrayed in a second direction intersecting the first direction, linear images of at least two colors, of the linear images of the plurality of colors, being positioned to overlap each other in the first direction, and wherein a linear image of a first color is arranged at substantially the same position as a linear image of a second color in the first direction; the second color differing from the first color.

* * * * *